US005899351A

United States Patent [19]

Murphy et al.

[11] Patent Number: 5,899,351

[45] **Date of Patent: * May 4, 1999**

[54] DEVICE FOR CONTAINING AND DELIVERING A PAYLOAD FROM A CONTAINER

[75] Inventors: Peter F. Murphy, Grosse Pointe, Mich.; James D. Brewer, Chicago, Ill.; Paul Doczy, Chicago, Ill.; David C. Brown, Chicago, Ill.

[73] Assignee: The Popstraw Company, LLC., Roseville, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/711,116

[22] Filed: Sep. 9, 1996

[51] Int. Cl.[6] ..... B65D 21/02

[52] U.S. Cl. ..... 220/23.86; 220/906; 220/703; 206/217

[58] Field of Search ..... 206/216, 217, 206/232; 220/23.83, 23.86, 906, 522, 703, 706, 709, 410, 408, 23.87

[56] References Cited

U.S. PATENT DOCUMENTS

| | | |
|---|---|---|
| 942,306 | 12/1909 | Clarke . |
| 1,253,579 | 1/1918 | Deanes . |
| 1,309,994 | 7/1919 | McAuliffe . |
| 1,997,914 | 1/1935 | Pollard . |
| 2,279,396 | 4/1942 | Hanson, Jr. . |
| 2,613,988 | 10/1952 | Jarbeau . |
| 2,710,108 | 6/1955 | Zarra . |
| 2,992,118 | 7/1961 | Daline . |
| 2,997,195 | 8/1961 | Yuen . |
| 3,099,565 | 7/1963 | Neuhauser . |
| 3,132,776 | 5/1964 | Wasserberg . |
| 3,211,379 | 10/1965 | Burton . |
| 3,220,587 | 11/1965 | Griffin et al. . |
| 3,226,001 | 12/1965 | Sequeira . |
| 3,303,984 | 2/1967 | Jurena . |
| 3,326,695 | 6/1967 | Neuhauser . |
| 3,349,955 | 10/1967 | Cornelius . |
| 3,547,308 | 12/1970 | Gilliem . |
| 3,558,033 | 1/1971 | Leeds . |
| 3,776,458 | 12/1973 | Chunga, Sr. . |
| 4,109,817 | 8/1978 | Payne et al. . |
| 4,194,674 | 3/1980 | Pearson . |
| 4,226,356 | 10/1980 | Lemelson . |
| 4,228,913 | 10/1980 | Mack et al. . |
| 4,356,927 | 11/1982 | Cooper et al. . |
| 4,379,511 | 4/1983 | del Fabro . |
| 4,411,359 | 10/1983 | Franco . |
| 4,537,324 | 8/1985 | Wang . |
| 4,690,294 | 9/1987 | Jones . |
| 4,709,829 | 12/1987 | Johnson et al. . |
| 4,728,001 | 3/1988 | Serba . |
| 4,733,785 | 3/1988 | Turner, Jr. et al. . |

(List continued on next page.)

*Primary Examiner*—Stephen J. Castellano
*Attorney, Agent, or Firm*—Bliss McGlynn, P.C.

[57] ABSTRACT

A device for containing and delivering a payload from a container which has a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice. The device includes a capsule disposed within the container for containing the payload. The device also includes a support structure disposed within the container and contacting the closed end, the device being held under compression solely between the closed end and the lid in response to a compressive force against the support structure by the container for securing alignment of the capsule with the orifice of the lid. The device further includes a guide on the support structure cooperating with the capsule for guiding the capsule to extend the payload through the orifice when the closure tab is deflected into the interior of the container to open the orifice.

21 Claims, 3 Drawing Sheets

U.S. PATENT DOCUMENTS 4,735,329 4/1988 Le .
4,792,083 12/1988 Yassur .
4,826,034 5/1989 Forbes .
4,877,148 10/1989 Larson et al. .
4,892,187 1/1990 Stein .
4,911,320 3/1990 Howes .
4,923,084 5/1990 Forbes .
4,925,040 5/1990 Wang .
4,930,652 6/1990 Murphy et al. .
4,966,300 10/1990 Coonradt .
5,054,639 10/1991 Ahn .
5,056,659 10/1991 Howes et al. .
5,080,247 1/1992 Murphy et al. .
5,160,058 11/1992 Ahn .
5,174,469 12/1992 Policapelli .
5,244,112 9/1993 Murphy et al. .
5,249,702 10/1993 Topp et al. .
5,253,779 10/1993 Lee .
5,282,541 2/1994 Chen .
5,334,400 8/1994 Purdham ..... 206/217
5,431,297 7/1995 Rosello .
5,482,158 1/1996 Plester .
5,484,080 1/1996 Blasnik et al. .
5,503,296 4/1996 DiBaggio .
5,547,103 8/1996 Murphy et al. .

DEVICE FOR CONTAINING AND DELIVERING A PAYLOAD FROM A CONTAINER

BACKGROUND OF THE INVENTION

1. Field of the Invention

The present invention relates generally to containers and, in particular, to a device for containing and delivering a payload from a container upon opening of the container.

2. Description of the Related Art

Previously, various devices have been proposed for incorporating payloads such as prizes in containers and for maintaining these prizes in positional alignment with orifices of the containers to insure that the prizes are available to a consumer when the containers are opened. U.S. Pat. Nos. 4,911,320, 5,056,659, and 5,099,232 issued to Howes describe various devices for containing and delivering prizes or prize announcements from a liquid container. However, one disadvantage of these patented devices is that they require special attachment to a non-standard container lid which results in complexity, expense, and possible premature detection. Another disadvantage of these patented devices is that they preclude the delivery of the actual liquid product which the consumer is attempting to purchase.

U.S. Pat. No. 5,482,158 issued to Plester describes a prize delivery device which is adapted to a standard beverage can and which enables some or possibly all of the actual liquid product to be dispensed from the beverage can. To maintain alignment with the can lid's orifice, however, portions of the device must be expanded outwardly against the interior surfaces of the can side walls.

One disadvantage of the above patented prize delivery device is that the effectiveness in maintaining alignment depends on the device's ability to firmly grip the interior surfaces of the can's side walls which are smooth and cylindrical and have no protrusions or recesses to mechanically lock the device in position. During the can lid-sealing process, during transport to the point of sale and when rolling along the guide channels of a vending machine or in-store refrigeration case, the can is subjected to gravitational, centrifugal, and vibratory forces which may overcome the prize delivery device's grip of the smooth interior can surfaces and thus cause the device to rotate out of its preset alignment with the orifice. Once out of alignment, the prize may not be noticeable when the consumer opens the can, or it may impede the flow of the liquid product out of the can.

Another disadvantage of this patented prize delivery device exists if the device is manufactured from materials like plastic whose coefficients of thermal contraction are greater than those of the standard aluminum or steel materials currently used for the cans. Hence, the pressure against the can's interior side walls exerted by the expandable portions of the device will lessen whenever the can is chilled—thereby increasing the risk of the device becoming misaligned to the orifice.

Yet another disadvantage of this patented prize delivery device exists when capillary forces in the liquid near the grips of the device and the interior side walls of the can change during aging and/or normal temperature cycling of the liquid product, and thereby weaken the adhesion strength of the grips against the interior side walls of the can.

A further disadvantage of this patented prize delivery device exists because its presence may be detectable by consumers prior to opening the can. The movable portions of the device are not latched or otherwise secured against motion prior to the opening of the can. Therefore, a consumer who inverts or shakes the can may detect the presence of the device by an audible sound it produces as its moving vial or vial-flange collides with other portions of the device. Detection is further risked because the device expands outwardly against the can side walls which are thin and may therefore enable the consumer to detect the device inside by squeezing the side walls from the exterior or by tapping the sidewalls and listening for a damped, less resonant sound than that produced by tapping a non-prize bearing can.

Yet a further disadvantage of this patented prize delivery device results from a flange and protrusion which are attached to its prize-holding vial. In the event the vial is assembled in an inverted position, the device will neither deliver the prize nor permit the consumer to fully open the can.

Still a further disadvantage of this patented prize delivery device results from its prize holding vial being unsecured. When the can is opened and its closure tab is deflected downward into the can interior, the closure tab must push a buoyant, freely-bobbing prizeholding vial downward in order for the tab to complete its arc of travel and end at a point which does not obstruct the upward buoyant travel of the vial. Because the vial is not secured, it is constantly bobbing against the sharp edges of the traveling closure tab which may result in its becoming wedged against the closure tab in which case the closure tab would not fully open and the vial would not float out through the orifice in the top of the can.

Additional disadvantages of this patented prize delivery device exist in the total number of component parts of the device, in the resulting complexity of the components and of their assembly method, in the narrow manufacturing tolerances required, and in the device's volumetric displacement which may prohibit the can from being filled with its normal amount of liquid.

SUMMARY OF THE INVENTION

It is, therefore, one object of the present invention to provide a device for containing and delivering a payload from a container.

It is another object of the present invention to provide a device for containing and delivering a prize or promotional device from a liquid container.

It is yet another object of the present invention to provide a device for containing and delivering a prize from a beverage can.

It is still another object of the present invention to provide a prize delivering device for use in liquid containers as the containers are shipped in a sealed condition from bottling, canning, sealing, packing or special prize-insertion factories.

It is a further object of the present invention to provide manufacturers, sellers, and consumers of packaged liquid containers with a device for providing and receiving prizes which is integrated with and allows for the dispensing of the actual liquid products from their standard containers.

It is yet a further object of the present invention to provide a prize delivery device which is undetectable prior to opening of a liquid container and which consistently and reliably functions according to its design intent when the container is opened.

It is still a further object of the present invention to provide a prize delivery device which does not adversely affect or degrade liquid or gas contained within and/or without the container.

It is another object of the present invention to provide a prize delivery device which is not adversely affected or degraded by the liquid or gas it is in contact with.

It is yet another object of the present invention to provide a device for the delivery of coins, bills and/or other monetary instruments from containers.

It is a further object of the present invention to provide a prize delivery device which is effective for all consumers who activate it.

It is yet a further object of the present invention to provide a device for the storage of additives and/or component ingredients within liquid containers.

It is still another object of the present invention to provide a prize delivery device which is more reliable, undetectable, and economical than prior patented devices by utilizing physical properties of the liquid and/or gas of standard liquid and/or gas container and of the container's geometric configurations to help deliver a prize to a consumer as or after the container is opened.

It is another object of the present invention to provide a device which combines or mixes additives and/or component ingredients with liquid contained inside a liquid container.

It is yet another object of the present invention to provide a device which injects a pre-designated liquid, solid or gas into liquid, solid or gas contained inside a container upon manipulation of the container by the end user.

It is still another object of the present invention to provide within a sealed container a device for the manipulation, measurement or dispensing of liquid, gas or powder in the container, including, but not limited to: pipettes, flexible droppers, spoons, stirring sticks, paddles, rods, measuring cups, dip sticks, syringes, intravenous systems, and the like.

It is a further object of the present invention to provide within a sealed container a device which conceals and/or protects and later delivers tools, weapons, medicine, foods, protective clothing and/or devices, electronic and/or optical instruments, radio or satellite communications devices, flares, and the like.

To achieve the foregoing objects, the present invention is a device for containing and delivering a payload from a container having a closed end and an open end and at least one side wall extending between the closed end and open end, a lid secured to the open end having an orifice, a closure tab pivotally connected to the lid and temporarily closing the orifice, and an actuating member pivotally secured to the lid and being manually actuated for moving the closure tab into the interior of the container to open the orifice. The device includes a capsule disposed within the container for containing a payload and a support structure disposed within the container and expanding radially against the closed end for supporting the capsule and a guide on the support structure cooperating with the capsule for guiding the capsule to extend the payload through the orifice when the closure tab is deflected into the interior of the container to open the orifice.

One advantage of the present invention is that a device is provided for containing and delivering a payload from a container. Another advantage of the present invention is that the device allows a self-contained prize or prize announcement to be delivered to a consumer upon opening of the container. Yet another advantage of the present invention is that a device is provided for delivering a prize or promotional announcement from a beverage can. Still another advantage of the present invention is that the device is used in liquid containers and receives prizes and allows dispensing of liquid from a standard beverage container. Still another advantage of the present invention is that the device is undetectable, reliable and economical, than prior devices. A further advantage of the present invention is that the device does not adversely affect or degrade the liquid or gas and is itself not adversely affected or degraded by the liquid or gas within the container. Yet a further advantage of the present invention is that the device may be used to deliver various payloads such as pipettes, flexible droppers, spoons, stirring sticks, paddles, rods, measuring cups, dip sticks, syringes, intravenous systems and the like.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
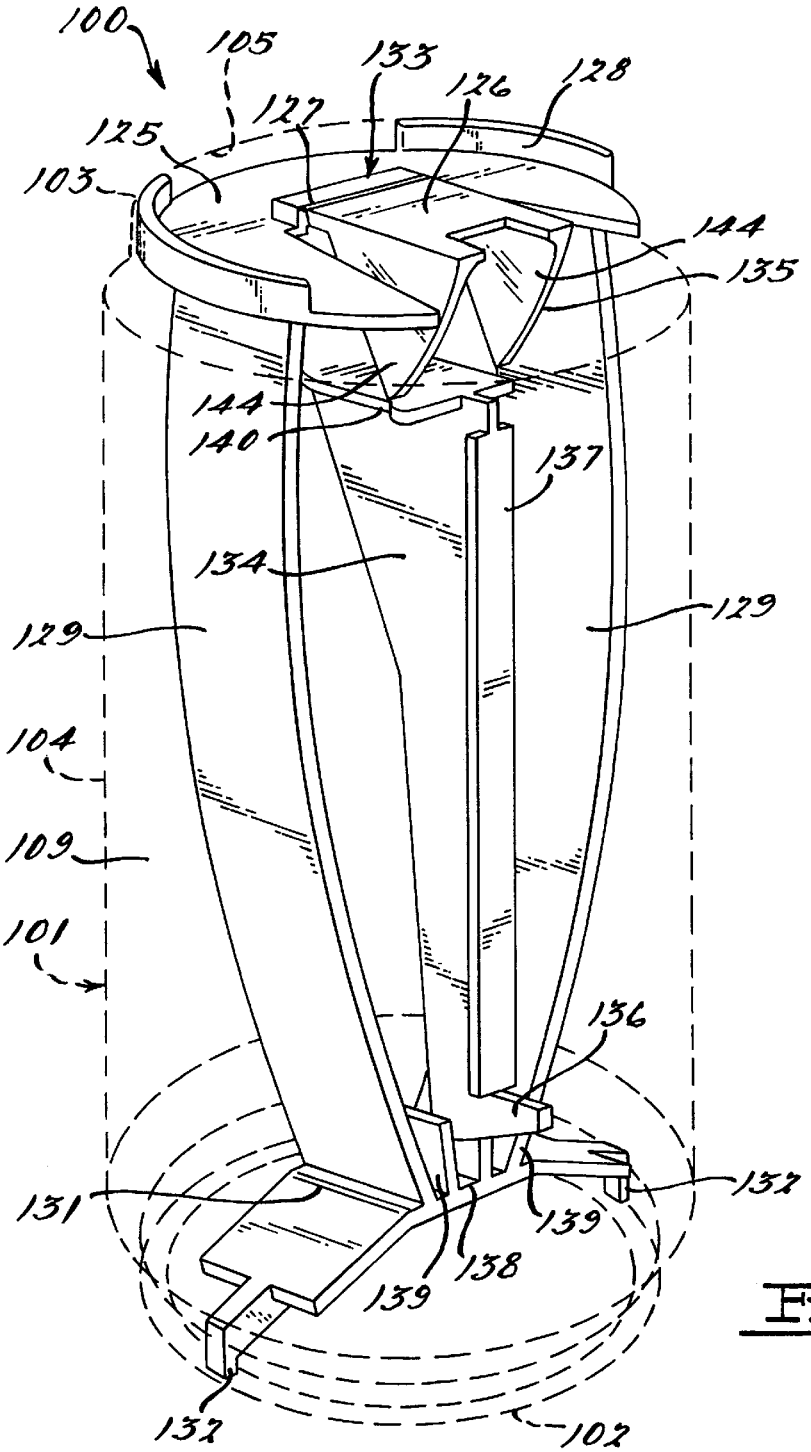
FIG. 1 is a perspective view of a device, according to the present invention, for containing and delivering a payload from a container illustrated without the payload.
Figure 2:
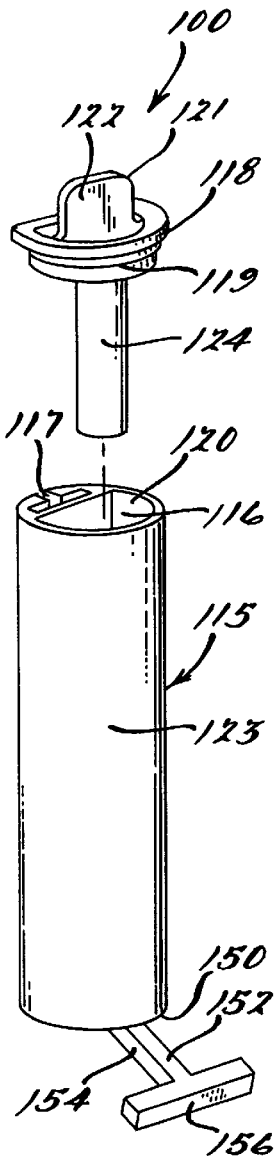
FIG. 2 is an exploded perspective view of a payload for the device of FIG. 1.
Figure 5:
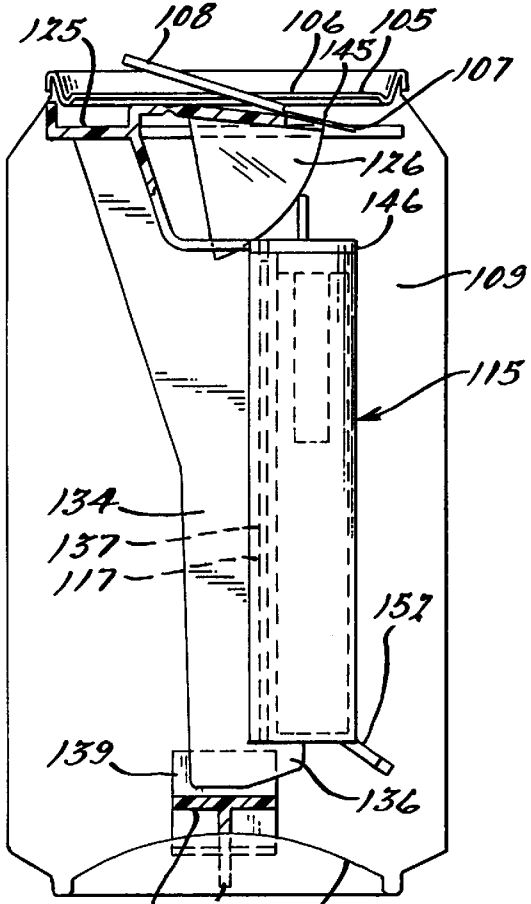
FIG. 5 is a fragmentary elevational view of the device and container of FIG. 1 illustrating the container beginning to be opened.
Figure 4:
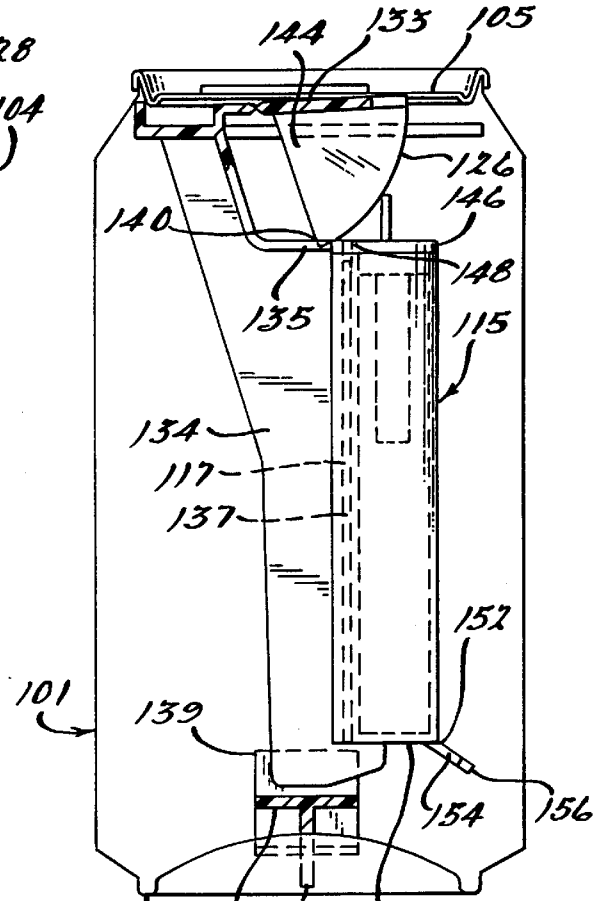
FIG. 4 is a fragmentary elevational view of the device and container of FIG. 1 illustrating the container prior to opening.
Figure 3:
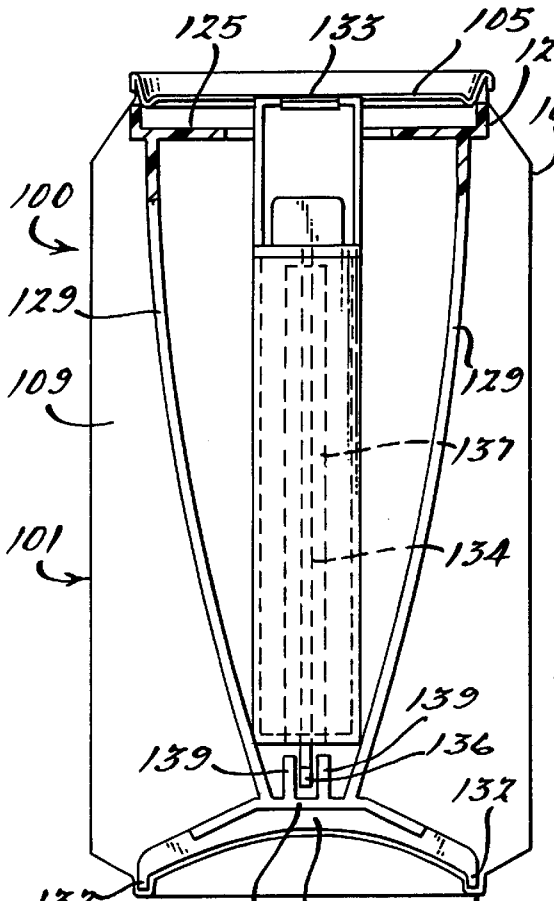
FIG. 3 is a fragmentary elevational view of the device and container of FIG. 1.

Referring to FIGS. 1 through 3, one embodiment of a device 100, according to the present invention, is illustrated in operational relationship with a container, generally indicated at 101. The container 101 has a closed end 102 and an open end 103 and at least one side wall 104 extending between the closed end 102 and the open end 103. The container 101 also includes a lid 105 secured to the open end 103 having an orifice 106 (FIG. 5) and a closure tab 107 (FIG. 5) pivotally connected to the lid 105 and temporarily closing the orifice 106. The container 101 further includes an actuating member 108 (FIG. 5) pivotally secured to the lid 105 and being manually actuated for moving the closure tab 107 into an interior 109 of the container 101 to open the orifice 106. Although the container 101 is shown as cylindrical, the device 100 could also be adapted to fit inside containers which are square, rectangular, or elliptical in their horizontal cross-section and straight or tapered in their vertical cross-section. It should be appreciated that the device 100 is self-contained and disposed in a liquid or gas within the container 101.

The delivery device 100 includes a generally cylindrical capsule 115 having a generally circular cross-sectional shape. The capsule 115 has an interior cavity 116 extending axially from one end which is adaptable for containing a wide variety of payloads which may be delivered through the orifice 106 in the lid 105 of the container 101 upon opening by the consumer. The capsule 115 also has a keyway 117 extending axially therethrough and having a generally "T" shaped configuration for a function to be described. It should be appreciated that the payload may be a prize or prize announcement.

When it is desirable to keep the payload fully separated from primary material contained within the interior 109 of the container 101, the capsule 115 may include a closure cap 118 to close the end of the interior cavity 116. The closure cap 118 has sides 119 of which press tightly against interior side walls 120 of the interior cavity 116 of the capsule 115, thereby achieving an hermetic seal until opened by the consumer. Optionally, a mechanical interlock, helical threads, adhesives, or molecular bonding may be provided to secure and/or create a hermetic seal between the sides 119 of the closure cap 118 and the interior side walls 120 of the capsule 115.

The closure cap 118 may also include a protruding tab 121 extending axially for gripping by the consumer during extraction of the closure cap 118 from the capsule 115. The protruding tab 121 has a pair of opposed faces 122. One or both faces 122 of the protruding tab 121 and/or exterior surfaces 123 of the capsule 115 may optionally be imprinted or embossed or labeled with indicia such as textual and/or graphical identification, instructions or other messages.

The closure cap 118 may also optionally include a mandrel 124 or a spindle, spool or other tool to facilitate winding, positioning and/or extraction of the payload from the interior cavity 116 of the capsule 115. It should be appreciated that the horizontal cross-section of a top portion of the capsule 115 may be of any size and shape which will pass through the opened orifice 106 in the lid 105 of the container 101.

The device 100 includes a generally circular top 125 disposed adjacent the lid 105. The top 125 includes a latch 126 which is flexibly hinged at 127 to allow the latch 126 to travel or rotate downward in response to downward movement by the closure tab 107. The top 125 also includes a flange or rim 128 extending axially and circumferentially thereabout.

The device 100 also includes a plurality, preferably a pair, of side legs 129 extending axially. Each of the side legs 129 is attached to the top 125 and opposing each other. Each of the side legs 129 is generally rectangular in shape and have an axial length greater than a circumferential width. The side legs 129 are preferably integral and unitary with the top 125.

The device 100 further includes a base 131 extending radially and connected to the other end of the side legs 129. The base 131 is generally rectangular and forms a generally inverted parabolic shape. The base 131 includes a foot 132 at each radial end extending axially for a function to be described. Preferably, the base 131 is integral and unitary with the side legs 129.

When the lid 105 has been affixed to the container 101, the lid 105 exerts a vertically downward force against the top 125 of the device 100. This force is transmitted through the side legs 129 to the base 131 of the device 100. The base 131 expands radially to hold the device 100 under compression between the lid 105 of the container 101 and the closed end 102 of the container 101. When the base 131 expands, the feet 132 engage bottom surfaces and/or bottom channel of the closed end 102. This compressive force enables the device 100 to remain aligned to the container 101 during processing, transport and consumer use. To maintain alignment additionally or alternatively, the top 125 of the device 100 may contain one or more raised and/or sunken sections which conform, fasten, adhere, interlock and/or grip to portions of embossed shapes and/or a lid actuating member fastener 133 protruding from the lid 105.

To insure that the maximum amount of available compressive force is applied directly to the top 125 and the base 131 of the device 100, the device 100 includes a center support 134 suspended from the top 125 of the device 100. The center support 134 extends axially and has a platform 135 at one end closest to the top 125 and a foot 136 at the other end closest to the base 131. The center support 133 has a guide track key 137 extending axially and generally perpendicular to the center support 134. The key 137 is generally rectangular in shape. The key 137 is disposed in the keyway 117 of the capsule 115. The foot 136 is spaced by a vertical gap between a top 138 of the base 131 and a pair of flanges 139 spaced from and opposing each other and extending axially from the top 138 of the base 131. It should be appreciated that no compressive force is transmitted through the center support 134 which enables the guide track key 137 to remain straight and perpendicular to the lid 105.

Referring to FIGS. 4 through 7, when installed in the container 101, the latch 126 of the device 100 remains upright by pressure exerted against the latch 126 by one or more detents 140 positioned on the sides of the platform 135. When the consumer begins to open the container 101 by raising the actuating member 108 on the exterior of the lid 105, the closure tab 107 begins to be deflected downward into the interior 109 of the container 101. The closure tab 107 engages a top surface of the latch 126, overcomes the resisting pressure of detents 140, and pushes the latch 126 downward from the hinge point 127 of the latch 126. The travel path of the closure tab 107 is indicated by the arc labeled 142 in FIGS. 6 and 7.

The specific gravity of the capsule 115 (including payload) is less than the specific gravity of the surrounding liquid inside the container 101, so a buoyant force exists which pushes the capsule 115 upward toward the lid 105 as long as liquid remains in the container 101. The latch 126, however, includes flaps 144 which prohibit this upward travel by interfering with a top edge 146 of the capsule 115 at point 148. Because the key-way 117 of the capsule 115 keeps the capsule 115 on top of and aligned to the guide track key 137 of the center support 134, the buoyant force which acts upon the capsule 115 is limited to acting upon a bottom surface 150 of the capsule 115 in a force vector which is always parallel to the guide track key 137.

In the event the container 101 is inverted prior to opening, the buoyant force will act on the capsule 115 to push it toward the closed end 102 of the container 101. To stabilize the capsule 115 in this event, the foot 136 of the center support 134 prohibits any travel of the capsule 115 in the direction of the closed end 102. This is necessary to prevent any audible sound resulting from a collision between the capsule 115 and the interior bottom surfaces of the closed end 102 of the container 101 which might render the capsule's 115 presence detectable to a consumer prior to opening the container 101; such pre-detection would not be desirable in those cases where the capsule 115 contained a prize as the payload because consumers could then simply invert the containers, and not select a particular container for purchase until they heard a capsule 115 colliding with the container interior.

Figure 7:
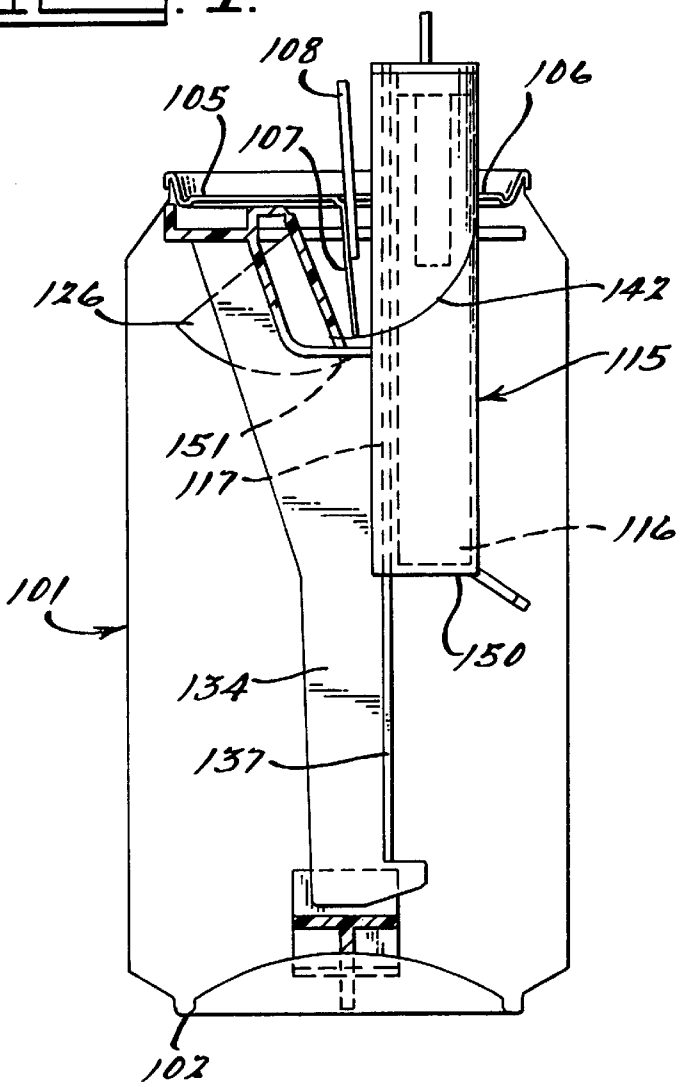
FIG. 7 is a fragmentary elevational view of the device and container of FIG. 1 illustrating the container being completely opened and the payload ascending through an opening in the container.
Figure 6:
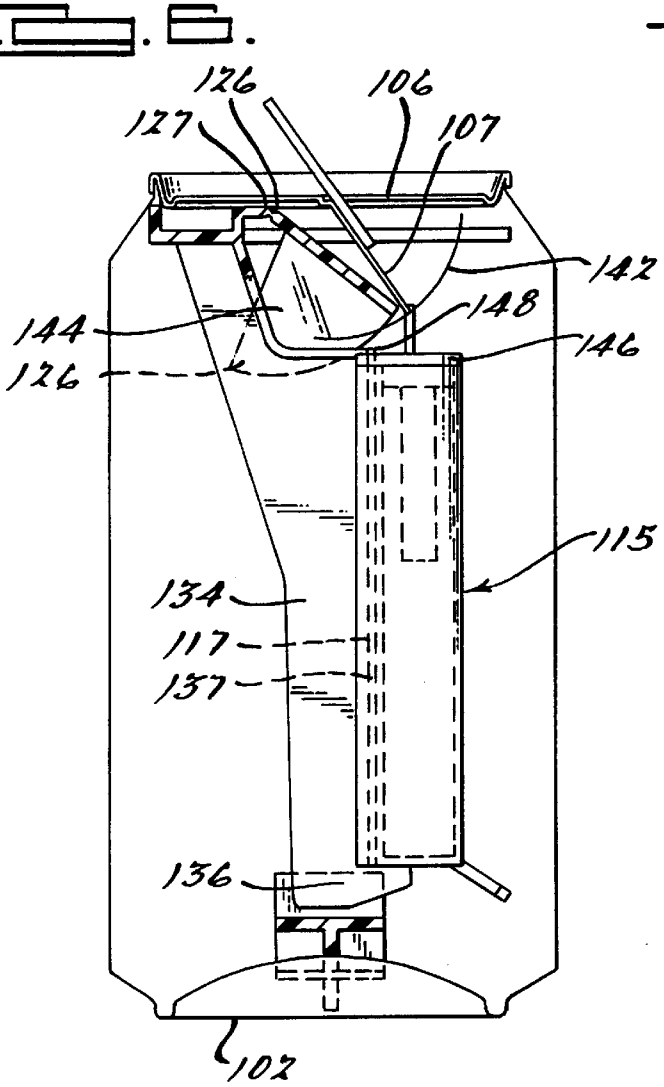
FIG. 6 is a fragmentary elevational view of the device and container of FIG. 1 illustrating the container approximately one-half opened.

Referring to FIG. 7, as the actuating member 108 becomes fully elevated, it deflects the closure tab 107 further along the closure tab's arc of travel 142 which, in turn, further deflects the latch 126 until the latch 126 no longer blocks the upward path of the buoyant capsule 115 at point 151. At the moment this blockage has been removed, the buoyancy of the capsule 115 is free to cause the capsule 115 to ascend through the orifice 106 in the lid 105 until the weight of the capsule 115 equilibrates with its buoyancy, and the bottom surface 150 of the capsule 115 floats in the liquid while the top surface 146 protrudes from the orifice 106 in a manner that makes the capsule 115 accessible to the consumer for manipulation and/or complete removal of the capsule 115 from the container 101.

Referring again to FIGS. 2 through 7, the bottom surface 150 of the capsule 115 in this embodiment is fitted with a leash 152 having a trunk 154 which terminates in a crossbar 156 that is perpendicular to the trunk 154 of the leash 152. The horizontal length of the crossbar 156 is sufficiently greater than the widest part of the orifice 106 of the lid 105 and the crossbar's rigidity is sufficiently stiff to resist flexure and consequent shortening of its horizontal length by the buoyant force so that the net effect of the leash 152 is to tether the capsule 115 to the container 101 thereby preventing the capsule 115 from completely emerging through the orifice 106 by the buoyant force alone. By effectively tethering the capsule 115 to the container 101, the tethering reduces the possibility of accidental ingestion of the capsule 115 or of the capsule's becoming lodged in the mouth or throat of the consumer. To fully extract the capsule 115 from the container 101 therefore requires the consumer to grasp the capsule 115 tightly and deliberately supply sufficient additional upward pulling force to flex the cross-bar 156, thereby shortening its length and thereby overcoming the interference between the cross-bar 156 and the area of the interior side of the lid 105 which surrounds the orifice 106.

Accordingly, the device 100 is held under compression between the lid 105 and the interior bottom surfaces and/or bottom channel of the closed end 102 of the container 101. Alignment of the device 100 to the orifice 106 of the lid 105 is secured by this compression and/or by interlocking with the embossed protrusions of the interior side of the lid 105 and/or by engaging the lid actuating member 108. When the container 101 is opened, the closure tab 107 sweeps the latch 126 about the latch hinge axis 127 which permits the payload-containing buoyant capsule 115 to ascend through the orifice 106 for access by the consumer. Payloads may be virtually any solids, liquids or gasses including, but not limited to cash prizes, redeemable coupons, credit cards, adhesives, sweeteners, medicines, curing agents.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload; and a support structure having a top and a base adapted to be disposed within the container such that said base contacts only the closed end, said device to be held under compression between the closed end and the lid in response to a compressive force against said support structure by the container for securing alignment of said capsule with the orifice of the lid, and a guide on said support structure cooperating with said capsule for guiding said capsule to extend the payload through the orifice when the closure tab is deflected into the interior of the container to open the orifice.

2. A device as set forth in claim 1 including at least one leg extending axially from said base.

3. A device as set forth in claim 2 wherein said top is connected to said at least one leg and disposed adjacent the lid for transmitting the compressive force to said at least one leg.

4. A device as set forth in claim 1 wherein said support structure includes means for allowing said support structure to be compressed axially in response to a compressive force.

5. A device as set forth in claim 1 wherein said top includes a rim cooperating with the lid.

6. A device as set forth in claim 1 wherein said support structure includes a center support suspended from said top.

7. A device as set forth in claim 6 wherein said guide is generally rectangular in shape and perpendicular to said center support.

8. A device as set forth in claim 1 wherein said top includes a latch disposed within the container and hingedly attached thereto and cooperating with the closure tab.

9. A device as set forth in claim 1 wherein said capsule is generally cylindrical in shape and has an interior cavity extending axially from one end therein to contain the payload.

10. A device as set forth in claim 9 including a closure for closing the interior cavity.

11. A device as set forth in claim 9 including a leash extending from said capsule of a size greater than the orifice to tether said capsule to the container thereby preventing said capsule from completely exiting the orifice in the lid without user interaction.

12. A device as set forth in claim 9 wherein said capsule includes a protrusion extending from a closed end thereof to extend through the orifice to be grasped by a consumer.

13. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure adapted to be disposed within the container and to contact the closed end, said device to be held under compression between the closed end and the lid in response to a compressive force against said support structure by the container for securing alignment of said capsule with the orifice of the lid, and a guide on said support structure cooperating with said capsule for guiding said capsule to extend the payload through the orifice when the closure tab is deflected into the interior of the container to open the orifice;

said support structure comprising a base disposed adjacent the closed end and a top disposed adjacent the lid for receiving the compressive force; and a plurality of legs spaced circumferentially and extending between said top and said base.

14. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a payload adapted to be disposed within the container; and a support structure having a top and bottom adapted to be disposed within the container and to contact the closed end, said device to be held under compression between the closed end and the lid, and said bottom does not contact the at least one side wall therebetween in response to a compressive force against said support structure by the container for supporting said payload and securing alignment of said payload with the orifice of the lid, and a guide on said support structure cooperating with said payload for guiding said payload to extend through the orifice when the closure tab is deflected into the interior of the container to open the orifice.

15. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure adapted to be disposed within the container and to contact the closed end, said device to be held under compression between the closed end and the lid in response to a compressive force against said support structure by the container for securing alignment of said capsule with the orifice of the lid, and a guide on said support structure cooperating with said capsule for guiding said capsule to extend the payload through the orifice when the closure tab is deflected into the interior of the container to open the orifice;

said support structure comprising a base and at least one leg extending axially from said base; and at least one foot extending from said base to engage the closed end.

16. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure adapted to be disposed within the container and to contact the closed end for supporting said capsule and a guide on said support structure cooperating with said capsule for guiding said capsule to extend the payload through the orifice when the closure tab is deflected into the interior of the container to open the orifice;

said capsule is generally cylindrical in shape and has an interior cavity extending axially from one end therein to contain the payload; and said capsule includes a keyway extending axially therethrough for receiving said guide.

17. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure adapted to be disposed within the container and to contact the closed end, said device to be held under compression between the closed end and the lid in response to a compressive force against said support structure by the container for securing alignment of said capsule with the orifice of the lid, and a guide on said support structure cooperating with said capsule for guiding said capsule to extend the payload through the orifice when the closure tab is deflected into the interior of the container to open the orifice;

said support structure including a top having a rim cooperating with the lid and a center support suspended from said top; and wherein said guide comprises a key extending along said center support and said center support includes at least one protrusion to limit travel of said capsule along said key.

18. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure adapted to be disposed within the container and to contact the closed end, said device to be held under compression between the closed end and the lid in response to a compressive force against said support structure by the container for securing alignment of said capsule with the orifice of the lid, and a guide on said support structure cooperating with said capsule for guiding said capsule to extend the payload through the orifice when the closure tab is deflected into the interior of the container to open the orifice;

said capsule being generally cylindrical in shape and having an interior cavity extending axially from one end therein to contain the payload; and wherein said capsule includes a keyway extending axially therealong for receiving said guide.

19. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure adapted to be disposed within the container and to contact the closed end, said device to be held under compression between the closed end and the lid in response to a compressive force against said support structure by the container for securing alignment of said capsule with the orifice of the lid, and a guide on said support structure cooperating with said capsule for guiding said capsule to extend the payload through the orifice when the closure tab is deflected into the interior of the container to open the orifice;

a leash extending from said capsule for resisting said capsule from completely exiting the orifice in the lid; and wherein said leash comprises a trunk extending from one end of said capsule and a crossbar perpendicular to said trunk having a length greater than the orifice in the lid.

20. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure adapted to be disposed within the container and to contact the closed end, said device to be held under compression between the closed end and the lid in response to a compressive force against said support structure by the container for securing alignment of said capsule with the orifice of the lid, and a guide on said support structure cooperating with said capsule for guiding said capsule to extend the payload through the orifice when the closure tab is deflected into the interior of the container to open the orifice;

said support structure including a top having a rim cooperating with the lid and a center support suspended from said top, said top including a latch hingedly attached thereto and cooperating with the closure tab; and wherein said latch includes a pair of flaps spaced radially and extending axially to cooperate with said center support.

21. A device for containing and delivering a payload from a container having a closed end and an open end and at least one side wall extending between the closed end and open end, a lid secured to the open end having an orifice, a closure tab pivotally connected to the lid and closing the orifice, and an actuating member pivotally secured to the lid and being manually actuated for moving the closure tab into the interior of the container to open the orifice comprising:

a capsule adapted to be disposed within the container for containing the payload;

a support structure having a top and a base adapted to be disposed within the container such that said base contacts only the closed end, said device to be held under compression between the closed end and the lid, and said base does not contact the at least one side wall therebetween in response to a compressive force against said top and/or said base by the container for supporting said capsule and securing alignment of said capsule with the orifice of the lid, and a guide on said support structure cooperating with said capsule for guiding said capsule to extend the payload through the orifice when the closure tab is deflected into the interior of the container to open the orifice;

at least one leg extending axially from said base; and said top being connected to said at least one leg and adapted to be disposed adjacent the lid for receiving the compressive force.

* * * * *